US005807089A

United States Patent [19]

Tsumagari et al.

[11] Patent Number: 5,807,089

[45] Date of Patent: Sep. 15, 1998

[54] SCROLL TYPE COMPRESSOR WITH A REINFORCED ROTATION PREVENTING MEANS

[75] Inventors: Yuichi Tsumagari, Toyokawa; Shigeki Iwanami, Okazaki; Shigeru Hisanaga, Kariya; Yasuhiro Oki, Okazaki; Shinya Yamamoto, Kariya; Tetsuya Yamaguchi, Kariya; Shinsuke Aso, Kariya; Tetsuo Yoshida, Kariya; Masao Iguchi, Kariya; Yasushi Watanabe, Kariya; Izuru Shimizu, Kariya, all of Japan

[73] Assignees: Nippondenso Co., Ltd.; Kabushiki Kaisha Toyoda Jidoshokki Seisakusho, both of Kariya, Japan

[21] Appl. No.: 659,985

[22] Filed: Jun. 7, 1996

[30] Foreign Application Priority Data

| | | | |
|---|---|---|---|
| Jun. 9, 1995 | [JP] | Japan | 7-168032 |
| Jun. 12, 1995 | [JP] | Japan | 7-144893 |
| Jun. 12, 1995 | [JP] | Japan | 7-144894 |

[51] Int. Cl.[6] ..... F04C 18/04

[52] U.S. Cl. ..... 418/55.3

[58] Field of Search ..... 418/55.3, 151

[56] References Cited

U.S. PATENT DOCUMENTS

| | | | |
|---|---|---|---|
| 4,527,963 | 7/1985 | Terauchi | 418/55.3 |
| 5,141,422 | 8/1992 | Ito et al. | 418/55.3 |
| 5,545,020 | 8/1996 | Fukanuma et al. | 418/55.3 |

FOREIGN PATENT DOCUMENTS

| | | |
|---|---|---|
| 0 656 477 | 6/1995 | European Pat. Off. . |
| 62-199983 | 9/1987 | Japan . |

*Primary Examiner*—John J. Vrablik

*Attorney, Agent, or Firm*—Cushman Darby & Cushman IP Group of Pillsbury MAdison & Sutro LLP

[57] ABSTRACT

A scroll type compressor having a housing unit in which a movable scroll element and a stationary scroll element are received in such a relationship that the movable scroll element orbits about the center of the stationary scroll element. The scroll type compressor further having a mechanical reinforced rotation preventing unit for preventing rotation of the movable scroll element about its own axis, and the rotation preventing unit having first stationary pin fixed to an inner end face of the housing unit and second movable pin fixed to an end face of a base plate of the movable scroll element, and a ring engaged with the first and second rings. A thickness T1 between the outer circumference of the first pin and the inner edge of the inner end face of the housing unit is set to be equal to or larger than 2.4 mm. A thickness T2 between the outer circumference of the second pin and the outer circumference of the base plate of the movable scroll element is set to be equal to or larger than 2.7 mm. A radial wall thickness T3 of the ring between the outer and inner cylindrical surfaces thereof is set to be equal to or larger than 1.7 mm.

3 Claims, 12 Drawing Sheets

(MEASURING RESULT OF LOAD APPLIED TO STATIONARY PINS 41 UNDER RUNNING CONDITION C1)

(MEASURING RESULT OF BREAKING LOAD WITH RESPECT TO FRONT HOUSING)

(MEASURING RESULT OF BREAKING LOAD WITH RESPECT TO BASE PLATE OF MOVABLE SCROLL ELEMENT)

(MEASURING RESULT OF BREAKING LOAD WITH RESPECT TO RINGS)

SCROLL TYPE COMPRESSOR WITH A REINFORCED ROTATION PREVENTING MEANS

BACKGROUND OF THE INVENTION

1. Field of the Invention

The present invention relates to a scroll type compressor having a stationary scroll element and a movable or orbiting scroll element, and more particularly, to an improved rotation preventing means for preventing rotation of the movable scroll element and for permitting an orbital motion of the movable scroll element.

2. Description of the Related Art

Generally, a scroll type compressor includes a housing, which houses a stationary scroll element having a fixed base plate with a spiral or wrap element fixed to an end face of the fixed base plate and a movable scroll element having a base plate with a movable spiral or wrap element fixed to an end face of the base plate. The spiral elements of the stationary and movable scroll elements are mutually engaged with one another to define compression chambers in the shape of pockets moving from an outer portion of the stationary and movable scroll elements toward the center of both elements. Namely, when the movable scroll element orbits about the center of the stationary scroll element, the pocket-like compression chambers are gradually shifted from the outer portion of the engaged spiral elements of both stationary and movable scroll elements to the center of both elements so as to compress a fluid which is, typically, a refrigerant gas.

The above-mentioned scroll type compressor is conventionally provided with a rotation preventing means for preventing the movable scroll element from rotating about its own axis and to permit it to perform an orbiting motion about the center of the stationary scroll element. A typical rotation preventing means is disclosed in Japanese Unexamined Patent Application Publication (Kokai) No. 62-199983, which includes a plurality of pin and ring assemblies, each being provided with a first pin fixedly attached to the base plate of the movable scroll element, a second pin fixedly attached to an inner wall of the housing confronting the base plate of the movable scroll element, and a ring element fitted around outer ends of the first and second pins. Thus, when the movable scroll element orbits around the central axis of the stationary scroll element, the first pins of the pin and ring assemblies attached to the movable scroll element turn around the second pins attached to the inner wall of the housing under the control by the ring element. Thus, the movable scroll element is prevented from rotating about its own axis, and is caused to orbit about the center of the stationary scroll element.

Nevertheless, in the scroll type compressor provided with the conventional rotation preventing means, when the compressor is operated under such a condition that a liquid-state refrigerant returns from an external refrigerating system to the compressor, the compressor is subjected to a large load due to compression of the liquid-state refrigerant, and a large torque is applied to the pin and ring assemblies of the rotation preventing means. Therefore, a problem may occur in that the housing, the outer ends of respective pins of the rotation preventing means attached to the base plate of the movable scroll element, and the rings of the rotation preventing means might be damaged or broken.

SUMMARY OF THE INVENTION

Therefore, an object of the present invention is to obviate the above-mentioned problem encountered by the conventional rotation preventing means of a scroll type compressor.

Another object of the present invention is to provide a scroll type refrigerant compressor provided with a rotation preventing means which is reinforced so as to have a mechanical strength sufficient for protecting pins and rings of the rotation preventing means against damage and breakage.

A further object of the present invention is to provide a rotation preventing means for a movable scroll element of a scroll type compressor, including a plurality of pin and ring assemblies arranged between a housing of the compressor and the movable scroll element and protected against damage and breakage even when the compressor is operated under an excessively large load condition.

A still further object of the present invention is to provide a scroll type compressor provided with a mechanically reinforced rotation preventing means for a movable scroll element, and a counter weight which is improved so as to permit the reinforced rotation preventing means to be accommodated in the interior of the compressor, and simultaneously to sufficiently counteract a centrifugal force generated by the orbiting motion of the movable scroll element.

In accordance with the present invention, there is provided a scroll type compressor including:

a housing means defining therein a chamber which receives a compressing mechanism and has a predetermined inner end face, a stationary scroll element received in the chamber of the housing means and having a stationary base plate positioned to be spaced apart from the predetermined inner end face of the housing means and a stationary spiral or wrap element attached to the stationary base plate, a movable scroll element received in the chamber of the housing means and having a movable base plate positioned to adjoin the predetermined inner end face of the housing means at one of the opposite end faces thereof and a movable spiral or wrap element integrally attached to the other of the opposite end faces of the movable base plate, the stationary and movable scroll elements being engaged with one another so as to define a plurality of compression chambers therebetween for compressing a refrigerant, a drive means for driving the movable scroll element so as to orbit about a center of the stationary scroll element to thereby cause a shifting of the plurality of compression chambers from an outer portion to a central portion of the respective spiral elements of the stationary and movable scroll elements, the shifting of the compression chambers gradually compressing a refrigerant, and a rotation preventing means for preventing the scroll element from being rotated about its own axis when the movable scroll element orbits about the center of the stationary scroll element, the rotation preventing means including a plurality of angularly spaced pairs of pins, each pair of pins having a first pin fixedly attached to the predetermined flat inner face of the housing means to be spaced apart from one another and a second pin fixedly attached to an end face of the movable base plate of the movable scroll element, the first and second pins being arranged to be parallel with one another, and a plurality of rings fitted around the plurality of pairs of pins so as to cooperate with the pins to thereby prevent the rotation of the movable scroll element, wherein the plurality of first pins of the rotation preventing means fixed to the predetermined flat inner face of the housing means are arranged to be spaced apart radially from a circular inner edge of the predetermined flat inner face extending around the chamber of the housing means, a thickness of the housing means measured between an outer surface of the respective first pins and the circular inner edge of the predetermined flat inner face being predetermined to be equal to or larger than 2.4 mm.

The predetermination of the thickness of the housing means is made on the basis of an experimental analysis of a load applied to the respective first pins of the rotation preventing means, and the respective first pins can be mechanically reinforced so as to be prevented from being damaged or broken even under a usual running condition of the compressor, such as a condition where a liquid-state refrigerant must be compressed. Further, in accordance with the present invention, the plurality of second pins of the rotation preventing means fixed to the end face of the movable base plate of the movable scroll element are arranged to be spaced apart radially from a substantially circular outer edge of the movable base plate, a thickness of the movable base plate defined between an outer surface of the respective second pins and the circular outer edge of the movable base plate being predetermined to be equal to or larger than 2.7 mm.

The predetermination of the thickness of the movable base plate at the outer portion thereof is again made on the basis of an experimental analysis of a load applied to the second pins of the rotation preventing means. Thus, the second pins of the rotation preventing means can mechanically reinforced to be prevent them from being damaged or broken.

Preferably, each of the plurality of rings fitted around the plurality of pairs of pins is formed to have a radial thickness between inner and outer circumferences thereof which is predetermined to be equal to or larger than 1.7 mm.

The predetermination of the radial thickness of the rings is again made on the basis of an experimental analysis of a load applied to the respective rings of the rotation preventing means. Thus, the rings of the rotation preventing means can be mechanically reinforced to be prevent them from being damaged or broken.

BRIEF DESCRIPTION OF THE DRAWINGS

The above and other objects, features, and advantages of the present invention will be made more apparent from the ensuing description of preferred embodiments thereof, in conjunction with the accompanying drawings thereof wherein.

DESCRIPTION OF THE PREFERRED EMBODIMENTS

Figure 1:
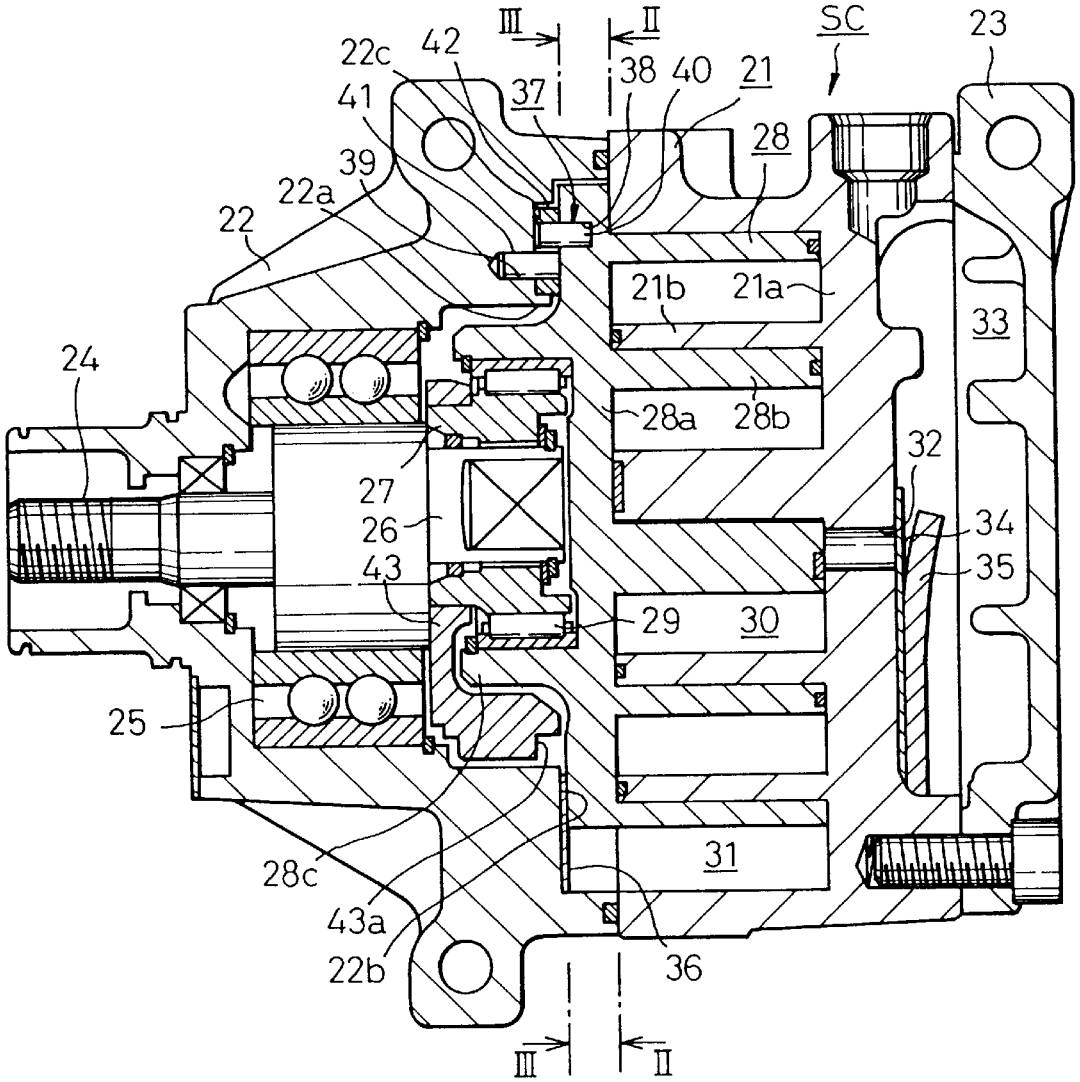
FIG. 1 is a longitudinal cross-sectional view of a scroll type compressor in which the mechanically reinforced rotation preventing means according to the present invention may be incorporated.
Figure 2:
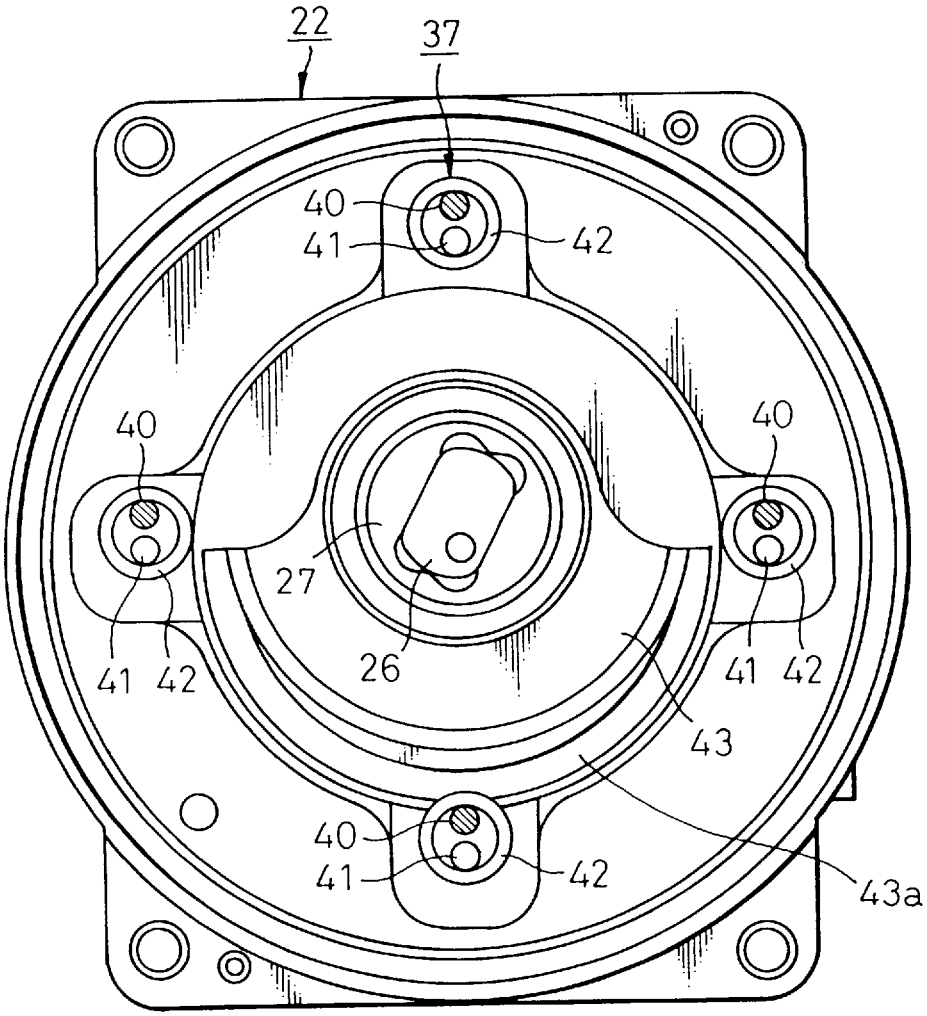
FIG. 2 is an end view taken of an internal portion of the compressor, taken along the line II—II of FIG. 1.
Figure 3:
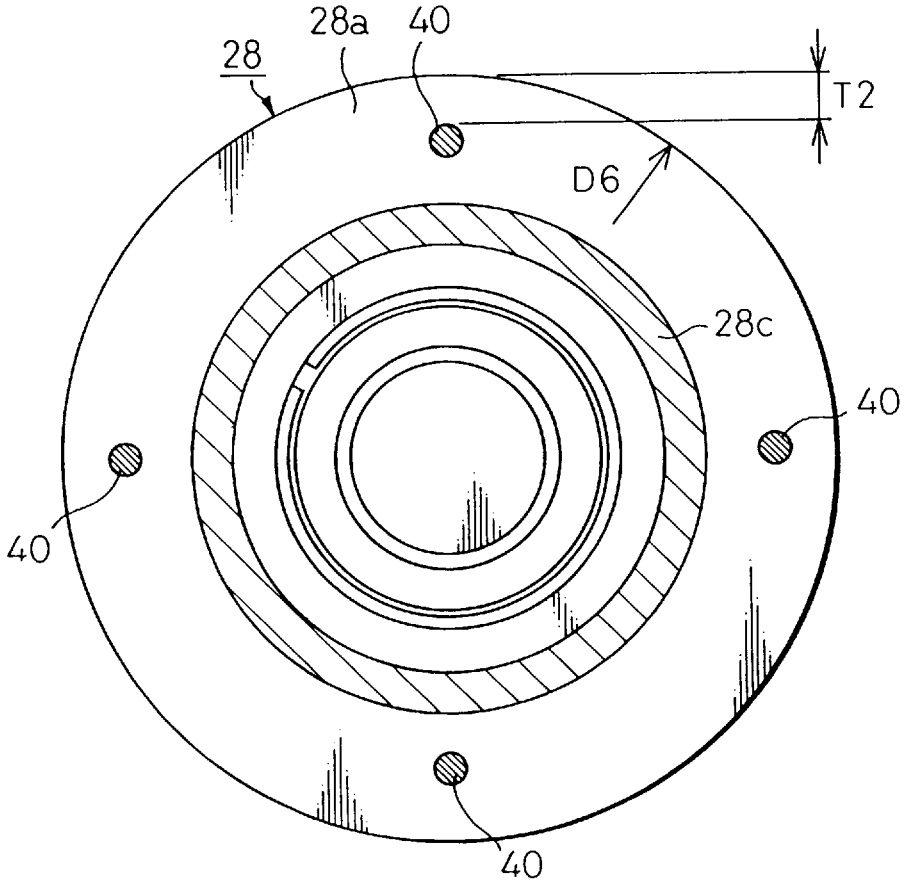
FIG. 3 is a cross-sectional view of the compressor, taken along the line III—III of FIG. 1.

Referring to FIGS. 1 through 3, a scroll type compressor SC is provided with a generally cylindrical housing assembly defining a substantially cylindrical main chamber for housing a scroll type compression mechanism. The housing assembly includes a front housing 22, a rear housing 23, and a central housing arranged between the front and rear housings 22 and 23. The central housing is provided with a stationary scroll element 21 having axially front and rear ends closed by the above-mentioned front and rear housings 22 and 23. The stationary scroll element 21, the front housing 22, and the rear housing 23 are made of aluminum or aluminum alloy to reduce the overall weight of the housing assembly.

An axial drive shaft 24 driven by an external drive force is rotatably supported by the front housing 22 at a central portion thereof, via an anti-friction radial bearing 25. The axial drive shaft 24 has an outer end extending outwardly and having screw threads formed therein and a large-diameter inner end from which an eccentric drive rotor 26 extends axially toward the interior of the main chamber of the housing assembly.

A bush element 27 is rotatably supported on the eccentric drive rotor 26, and has a balancing weight or counterweight 43 fitted around an outer circumference thereof at a position adjacent to the large diameter portion of the drive shaft 24. On the bush element is rotatably mounted a movable scroll element 28 via an anti-friction roller type bearing 29. The movable scroll element 28 has a boss portion 28*c* fitted on the outer race member of the bearing 29, and therefore, the movable scroll element 28 is urged to orbit about an axis of rotation of the axial drive shaft 24 via the eccentric drive rotor 26, the bush element 27, and the bearing 29 when the axial drive shaft 24 is rotationally driven by the external drive force. The movable scroll element 28 is made of an aluminum or aluminum alloy in order to reduce the overall weight of the compressor and to reduce or suppress a centrifugal force acting thereon which is generated by the orbiting motion of the movable scroll element 28.

The stationary scroll element 21 is provided with a stationary base plate 21*a* and a stationary spiral or wrap member 21*b* integrally formed with the stationary base plate 21*a* and extending from an inner face of the base plate 21*a* into the main chamber of the housing assembly. Similarly, the movable scroll element 28 is provided with a movable base plate 28*a* and a movable spiral or wrap member 28*b* integrally formed with the movable base plate 28*a* so as to extend from an inner end face of the base plate 28*b* into the main chamber of the housing assembly. The stationary and movable spiral members 21*b* and 28*b* of the two scroll elements 21 and 28 are engaged with one another. An axial end of the stationary spiral member 21*b* is in sealing contact with the inner face of the movable base plate 28*a*, and an axial end of the movable spiral members 28*b* is in sealing contact with the inner face of the stationary base plate 21*a*. Thus, the stationary and movable scroll elements 21 and 28 define a plurality of independent sealed pockets, i.e., compression chambers 30, between the spiral members 21*b* and 28*b*.

The scroll type compressor SC is further provided with a suction chamber 31, for a refrigerant gas before compression, which is arranged so as to extend between an outermost circumferential wall of the stationary scroll element 21 and an outermost portion of the movable spiral member 28*b* of the movable scroll element 28. The suction chamber 31 receives the refrigerant gas when it is introduced from an external refrigerating system via an inlet port (not shown) which is formed in the front housing 22.

An outlet port 32 is formed in a central portion of the stationary base plate 21*a* of the stationary scroll element 21 so as to provide a fluid communication between the respective suction chambers 30 and a discharge chamber 33 defined in the rear housing 23 of the housing assembly. The discharge chamber 33 can be fluidly connected to the external refrigerating system. In the discharge chamber 33 is arranged a discharge valve 34 which closes the discharge port 32 and is moved to an opening position thereof where it is backed up by a plate-like retainer 35 disposed in the discharge chamber 33. The retainer 35 limits the opening of the discharge valve 34 to a predetermined extent.

An annular fixed plate 36 is disposed so as to be seated against one of the inner faces of the front housing 22, which extends perpendicularly to the axis of rotation of the drive shaft 24. Namely, the annular fixed plate 36 is in close contact with an inner face 22*b* of the front housing 22, and is also in direct contact with or in connection to an outer end face of the movable base plate 28*a* which is opposite to the afore-mentioned inner end face from which the movable spiral member 28*b* extends. The annular plate 36 is arranged so as to receive an axial thrust force acting on the movable scroll element 28, when the refrigerant gas is compressed within the respective compression chambers 30.

As shown in FIGS. 1 through 4, a rotation preventing means including a plurality of rotation preventing mechanisms 37 which are arranged between the outer end face of the movable base plate 28*a* of the movable scroll element 28 and one of the inner end faces of the front housing 22, i.e., an inner end face 22*c* which confronts the outer end face of the movable base plate 28*a*. The respective rotation preventing mechanisms 37 are provided for preventing rotation of the movable scroll element 28, and permits the movable scroll element 28 only to perform an orbital motion about the center of the stationary scroll element 21.

Each of the rotation preventing mechanisms 37 is provided with a pair of pins in the shape of short straight cylindrical rods, i.e., a pin 40 (which corresponds to a second pin in the claims) and a pin 41 (which corresponds to a first pin in the claims). Each rotation preventing mechanism 37 is also provided with a ring 42 which is arranged in a manner to be described later.

The pins 40 and 41 and the ring 42 of each rotation preventing mechanism 37 are preferably made of iron system material such as, for example, cast steel.

The pin 40 is fixedly fitted in a bore 38 formed in the movable base plate 28*a* of the movable scroll element 28, and the pin 41 is press-fitted in a bore 39 formed in an inner face 22*c* of the front housing 22. The bores 38 and 39 are arranged to face one another, and are formed so that the pins 40 and 41 axially press-fitted therein are in parallel with the axis of rotation of the drive shaft 24 while having a predetermined space "$S_0$" therebetween at outer ends of respective pins 40 and 41 (see FIG. 4A). Further, each of the pins 40 and 41 is formed to have opposite ends deburred and rounded as specifically indicated as rounded corners 40*a* and 41*a* in FIG. 4B, so as to permit each of the pins 40 and 41 to be smoothly press-fitted accurately in position into the above-mentioned corresponding bore 38 or 39. Thus, the respective pins 40 and 41 are precisely parallel with the axis of rotation of the drive shaft 24 and with each other. Accordingly, pins 40 and 41 will not withdraw from their respective bores. The respective pins 40 and 41 have diameters D3 and D4 designed and determined so as to satisfy a later-described equation (1).

Figure 4A:
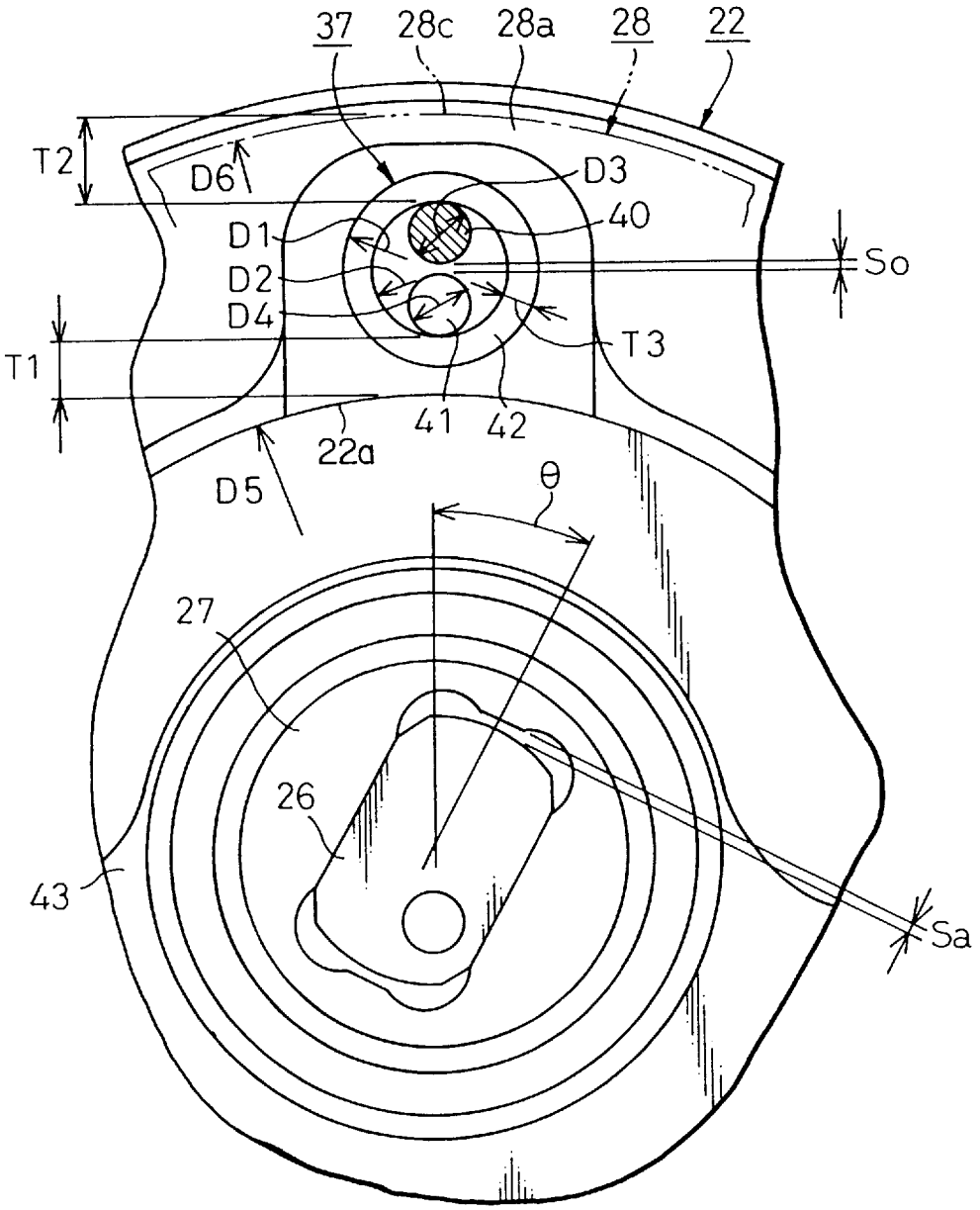
FIG. 4A is a partial enlarged view of an internal important portion of the compressor, illustrating the dimensional relationship between the pins of a rotation preventing means and a front housing or a movable base plate of the movable scroll element of the scroll type compressor.
Figure 4B:
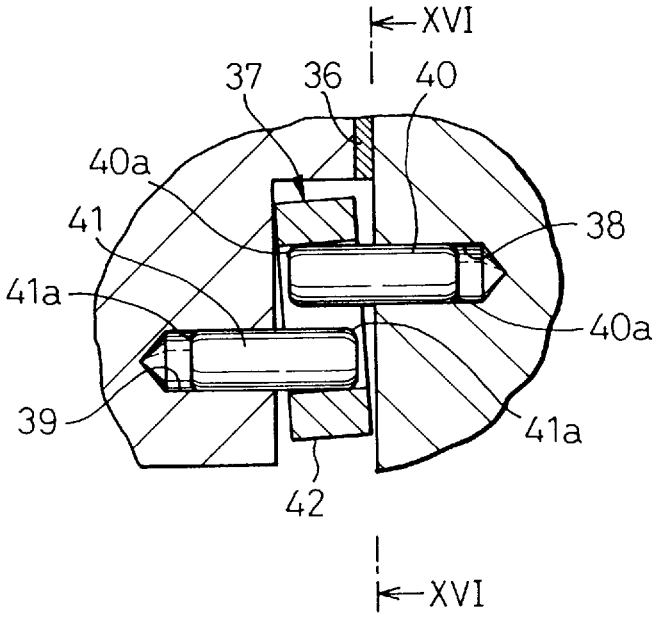
FIG. 4B is a partial cross-section view of the rotation preventing means, illustrating pins having rounded corners thereof press-fitted in bores of the housing and the movable base plate.

The ring 42 is designed and arranged so as to enclose the outer ends of the two pins 40 and 41. At this stage, since the pins 40 and 41 have the rounded corners 40*a* and 41*a* at the outer ends thereof, the pins 40 and 41 can smoothly engaged with the inner cylindrical surface of the ring 42 even when the ring 42 is inclined to its normal position, as shown in FIG. 4B, during the compressing operation of the scroll type compressor. Preferably, the outer cylindrical surface of the ring 42 is formed to have a rounded corner similar to the rounded corners 40*a* and 41*a* of the pins 40 and 41, so that the ring 42 is able to be in smooth contact with the inner face 22*c* of the front housing 22 even when the ring 42 is in an inclined posture, shown in FIG. 4B, during the compressing operation of the scroll type compressor.

Figure 4C:
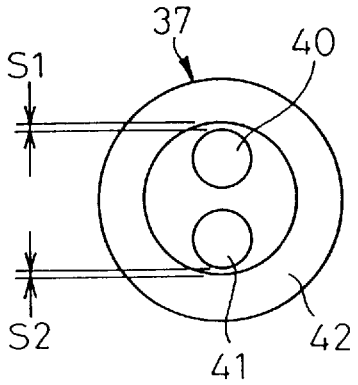
FIG. 4C is a cross-sectional view of the pins and the ring of the rotation preventing means.
Figure 16:
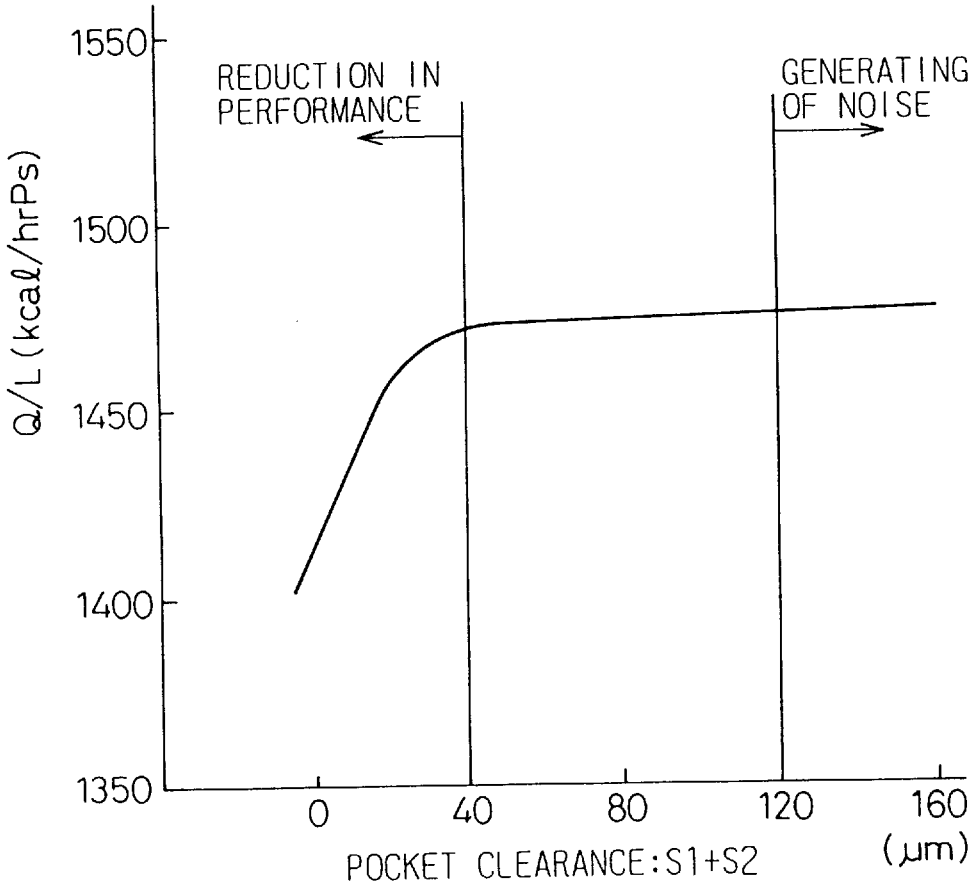
FIG. 16 is a graph illustrating a relationship between a pocket clearance and a compression performance of a scroll type compressor according to the present invention.

Further, there is provided small clearances $S_1$, and $S_2$ between the inner cylindrical surface of the ring 42 and the outer surfaces of the pins 40 and 41 as specifically shown in FIG. 4C. Preferably, the above-mentioned clearances $S_1$ *and* $s_2$ are selected so that the total amount of the clearances $S_1$ and $S_2$ (referred to as a pocket clearance) are between 40 microns ($\mu$m) through 120 microns ($\mu$m). When the clearances $S_1$ and $S_2$ between the inner cylindrical surface of the ring 42 and the outer surfaces of the pins 40 and 41 are selected to have a value in the above-mentioned dimensional range, a reduction in the compression performance of the scroll type compressor and the generation of noise during the operation of the scroll type compressor can be prevented as shown in the graph of FIG. 16.

In the above-described scroll type compressor, when the drive shaft 24 is rotationally driven by an external engine such as an automobile engine, the movable scroll element 28 is urged by the eccentric drive rotor 26 rotating with the drive shaft 24 to orbit around the center of the stationary scroll element 21. During the orbiting of the movable scroll element 28, the pins 40 of the respective rotation preventing mechanisms 37 of the rotation preventing means move around the related respective pins 41 under the restriction by the respective rings 42. Thus, the movable scroll element 28 is completely prevented from rotating about its own axis, and is permitted only to perform the above-mentioned orbiting motion. The orbiting motion of the movable scroll element 28 causes the respective compression chambers 30 to gradually shift from the outer portion of the engaged spiral members 21*b* and 28*b* of the stationary and movable scroll elements 21 and 28 toward the center of the two spiral members 21*b* and 28*b* while the inner volume of the compression chambers 30 is reduced. Therefore, the refrigerant gas sucked from the suction chamber 31 into the respective suction chambers 30 is gradually compressed with the respective compression chambers 30.

During the orbiting motion of the movable scroll element 28, a centrifugal force acting on the movable scroll element 28 and the eccentric drive element 26 is counterweighed by the balancing weight 43. Thus, the movable scroll element 28 does not adversely affect the radial bearings 25 and 29 during the orbiting motion of the movable scroll element 28. At this stage, the balancing weight 43 has a long radial arm with respect to the axis of rotation of the drive shaft 24 so as to exhibit a large counterweighting force, and is formed with a circumferentially extending recess 43*a* at a radial outer end thereof as best shown in FIGS. 1 and 2. Thus, the balancing weight 43 does not interfere with the rings 42 of each of the rotation preventing mechanisms 37 of the rotation preventing means during the operation of the scroll type compressor. The recess 43*a* of the balancing weight 43 may be formed by a cut.

The large counterweighting force of the balancing weight 43 can reduce abrasion of the bearings 25 and 29 and can reduce noise. Further, the large counterweighting force can reduce a loss in the drive power provided for the scroll type compressor.

In the above-described embodiment of the scroll type compressor, respective dimensions of the pins 40, 41, the wall thicknesses of the front housing 22 and the movable scroll element 28, and the ring 42 are determined on the basis of various experiments to analyze loads acting on the pins 40, 41, portions of the front housing 22 and the movable scroll element 28 for supporting the pins 40 and 41, and the rings 42 cooperating with the pins 40 and 41 to prevent rotation of the movable scroll element 28. The description of the results of the experiments conducted by the inventors of the present invention, to determine the dimensions of the pins 40, 41, the radial wall thicknesses of the front housing 22 and the movable scroll element 28, and the ring 42 will be provided below with reference to the various graphs shown in FIGS. 5 through 15, and to FIGS. 1 through 4.

A wall thickness T1 (FIG. 4) of the front housing 22 left between the outer circumference of each pin 41 press-fitted in the bore 39 of the front housing 22 and an inner cylindrical wall face 22*a* is set so as to be equal to or larger than 2.4 mm. Further, a wall thickness T2 (FIG. 4) of the movable base plate 28*a* of the movable scroll element 28 left between the outer circumference of each pin 40 press-fitted in the movable base plate 28*a* and an outermost circumference 28*c* of the movable base plate 28*a* is set so as to be equal to or larger than 2.7 mm. Further, a radial wall thickness T3 (FIG. 4) of each ring 42 defined as (D1−D2)/2 is set so as to be equal to or larger than 1.7 mm.

The results of the experiments for the analysis of the loads applied to the respective rotation preventing mechanisms 37 which were used for determining the above-mentioned dimensions T1 through T3 will be described below.

During the operation of the scroll type compressor, the respective rotation preventing mechanisms 37 of the rotation preventing means must be subjected to a large load which is caused by a reaction force generated by the compression of the refrigerant gas and the afore-mentioned centrifugal force of the movable scroll element 28. Thus, the rotation preventing mechanisms 37 must have a mechanical strength sufficient for preventing the rotation preventing mechanisms 37 from being either damaged or broken. Namely, the pins 40 and 41, the ring 42, and the portions of the front housing 22 and the movable base plate 28*a* of the movable scroll element 28 might be damaged or broken if the rotation preventing mechanisms have insufficient mechanical strength.

The mechanical strength of the pins 40 and 41 press-fitted in the bores 38 and 39 respectively of the movable scroll element 28 and front housing 22 may be increased if the diameters D3 and D4 of the pins 40 and 41 of each rotation preventing mechanism 37 are increased or the load applied to each mechanism 37 may be reduced if the number of rotation preventing mechanisms 37 is increased, for example, providing five or more mechanisms 37 equiangularly arranged so as to reduce a load component applied to each of the rotation preventing mechanisms 37. Nevertheless, an increase in the number of the mechanisms 37 leads to an increase in the manufacturing cost of the rotation preventing means, and further, seizure of the movable scroll element 28 occurs between the element 28 and the inner face 22*b* of the front housing 22 due to a reduction in the supporting area of the inner face 22*b* of the front housing 22 for receiving a thrust load applied to the inner face 22*b*. Accordingly, optimum number of arrangements of the rotation preventing mechanisms 37 of the rotation preventing means can be geometrically considered as three or four, and the three or four rotation preventing mechanisms 37 should be equiangularly disposed around the axis of rotation of the drive shaft 24 in order to equivalently support the load during the operation of the scroll type compressor. When the movable scroll element 28 performs one complete orbiting motion around the center of the stationary scroll element 21, the load applied to each of the three or four rotation preventing mechanisms 37 of the rotation preventing means changes in a sinusoidal curve manner having a half cycle of 120 degrees or 90 degrees, and accordingly, the peak load of the sinusoidally changing load is applied to each of the three or four rotation preventing mechanisms 37 once for one complete orbiting motion of the movable scroll element 28.

On the other hand, the increase in the diameters D3 and D4 of the pins 40 and 41 of each of the rotation preventing mechanisms 37 must be geometrically limited to given diameters less than predetermined dimensional values. Namely, as shown in FIG. 4A, the pin 40 of the movable base plate 28*a* of the movable scroll element 28 orbits around the pin 41 of the front housing 22 at an orbiting radius equal to that R (not shown) of the movable scroll element 28 orbiting around the center of the stationary scroll element 21. Therefore, the diameter D3 of the pin 40 and that D4 of the pin 41 needs to satisfy a formula (1) as set forth below.

$$(D3+D4)\times\tfrac{1}{2}<R \quad (1)$$

Further, in the case where a clearance "Sa" between the eccentric drive plate 26 and the movable scroll element 28 is adjustable so as to adjust the radius of the orbiting motion of the movable scroll element 28 to thereby achieve an optimum condition with the stationary scroll element 21, a formula (2) as set forth below must be satisfied.

$$(D3+D4)\times\tfrac{1}{2}<R-Sa\cdot\mathrm{COS}\theta \quad (2)$$

where θ indicates an inclination angle between the axis of the eccentric drive plate 26 and the line passing through the centers of both pins 40 and 41 as shown in FIG. 4A.

The formula (2) above may be changed into a formula (3) below.

$$\{(D3+D4)\times\tfrac{1}{2}\}+S_0<R \quad (3)$$

where $S_0$ indicates a space between the pins 40 and 41. Thus, the largest diameters D3 and D4 of the pins 40 and 41 must be predetermined so as to satisfy the formula (3).

The formula or inequality (3) states that even when the radius "R" of orbiting motion of the movable scroll element 28 is set to the minimum value, the pins 40 and 41 should not be in direct contact with one another. In a practical embodiment, the left side of the formula (3) is selected to be a further 0.1 mm smaller than the right side of the formula (3).

Further, since a load applied to the pin 40 is always equal to a load applied to the pin 41 due to the relationship of action and reaction, the diameters D3 and D4 should preferably be equal to each other. If a single equal diameter is employed for both pins 40 and 41, it is possible to use commonly manufactured pins for each of the pins 40 and 41.

The description of the strength of the ring 42 will be provided below.

The mechanical strength of the ring 42 may be increased by the method of increasing either a thickness thereof measured in the axial direction perpendicular to the diameter of the ring 42 or a radial thickness "T3" shown in FIG. 4A. However, the above-mentioned method causes the entire size of the scroll type compressor to become unfavorably large. Further, when the thickness of the ring 42 measured in the axial direction perpendicular to the diameter thereof is increased, the length of pins 40 and 41 must accordingly be increased. Consequently, the load applied to the pins 40 and 41 generates an unfavorably large moment acting on both pins 40 and 41. Thus, in the preferred embodiment of the present invention, it is preferable to increase the radial thickness T3 of the ring 42.

Further, the portion of the front housing 22 located around and supporting each pin 41 axially projecting therefrom is mechanically reinforced. Namely, as shown in FIG. 4A, the mechanical strength of the above-mentioned portion of the front housing 22 against a load applied to the rotation preventing mechanism 37 relies on a wall thickness T1 between the inner cylindrical wall surface 22*a* of the front housing 22 and the outer circumference of the pin 41 press-fitted in the bore 39 of the front housing 22. Therefore, an increase in the mechanical strength of the portion of the front housing 22 located around the pin 41 can be obtained by increasing the wall thickness T1, and an increase in the wall thickness T1 of the front housing 22 can be realized by reducing a diameter D5 of the inner cylindrical wall face 22*a* of the front housing 22 (see FIG. 4A). Nevertheless, since the balancing weight 43 is movably arranged in the chamber of the front housing 22 at a position surrounded by the inner cylindrical surface 22*a*, the reduction in the diameter D5 of the inner cylindrical wall face 22*a* requires an unfavorable reduction in the entire size of the balancing weight 43. Namely, when the size of the balancing weight 43 is reduced, a deterioration in the counterweighting performance of the balancing weight 43 occurs, and the centrifugal force generated by the orbiting motion of the balancing weight 43 cannot be well compensated for. Thus, vibration of the compressor, which is accompanied by generation of noise, cannot be suppressed.

Alternatively, when the location of the pins 41 of the respective rotation preventing mechanisms 37 is shifted radially outward with respect to the inner cylindrical wall face 22*a* of the front housing 22 without increasing the above-mentioned diameter D5, the portion of the front housing 22 around each pin 41 might be increased. Nevertheless, the shifting of the pins 41 will lead to an unfavorable increase in the entire size of the scroll compressor. Thus, the wall thickness T1 of the front housing 22 must be increased by taking into account different factors as described hereinbelow.

The mechanical strength of portions of the movable base plate 28*a* of the movable scroll element 28 located around the respective pins 40 axially projecting therefrom mostly relies on a wall thickness T2 extending between the outer circumference of the pins 40 and the outermost circumference 28*c* of the movable base plate 28*a* of the movable scroll element 28. Thus, an increase in the mechanical strength of portions of the movable base plate 28*a* located around the respective pins 40 can be obtained by increasing the wall thickness T2 shown in FIG. 4A.

An increase in the wall thickness T2 of the movable base plate 28*a* of the movable scroll element 28 may be obtained by increasing an outer diameter D6 (see FIG. 4A) of the base plate 28*a* of the movable scroll element 28. Nevertheless, the increase in the outer diameter D6 of the movable base plate 28*a* will lead to an unfavorable increase in the entire size of the scroll type compressor. Alternatively, when the location of the pins 40 is shifted radially inwards from the outer circumference of the movable base plate 28*a* of the movable scroll element 28 without an increase in the outer diameter D6 of the movable base plate 28*a* of the movable scroll element 28, the wall thickness T2 of the base plate 28*a* can be increased. However, the shifting of the pins 40 obviously requires shifting of the pins 41 in a direction reducing the wall thickness T1 of the front housing 22. Consequently, the afore-mentioned diameter D5 of the inner cylindrical wall face 22*a* of the front housing 22 must be decreased, which leads to the afore-mentioned problem of reduction in the counterweighing performance of the balancing weight 43.

From the foregoing, it will be understood that the mechanical strength of the pins 40 and 41, the rings 42, and the portions of the front housing 22 and the movable base plate 28*a* of the movable scroll element 28 located around the pins 40 and 41 are closely related to the manufacturing cost of the rotation preventing means, the entire size of the scroll type compressor, and the vibration of the compressor during the operation thereof. Therefore, the mechanical strength of the above-mentioned various components and the portions must be achieved so as not to cause increases in the manufacturing cost of the rotation preventing means of the compressor, the entire size of the scroll type compressor, and in the vibration of the scroll type compressor. Further, the strength of the pins 40, 41, the ring 42, the front housing 22, and the movable base plate 28*a* of the movable scroll element 28 must be increased so as to be harmonious with one another.

In order to determine the above-mentioned wall thickness of the front housing 22 and the movable base plate 28*a* of the movable scroll element 28 for the purpose of increasing the mechanical strength of the rotation preventing mechanisms 37 of the rotation preventing means, various experiments were conducted by the present inventors to measure practical data of the load applied to the rotation preventing mechanisms 37 of the rotation preventing means. It should be understood that various parts and elements of the scroll type compressor other than those of the rotation preventing means are not subjected to any appreciable load during the operation of the scroll type compressor. Thus, the conducted experiments were directed to the measurements of loads applied to the respective rotation preventing mechanisms.

Figure 5:
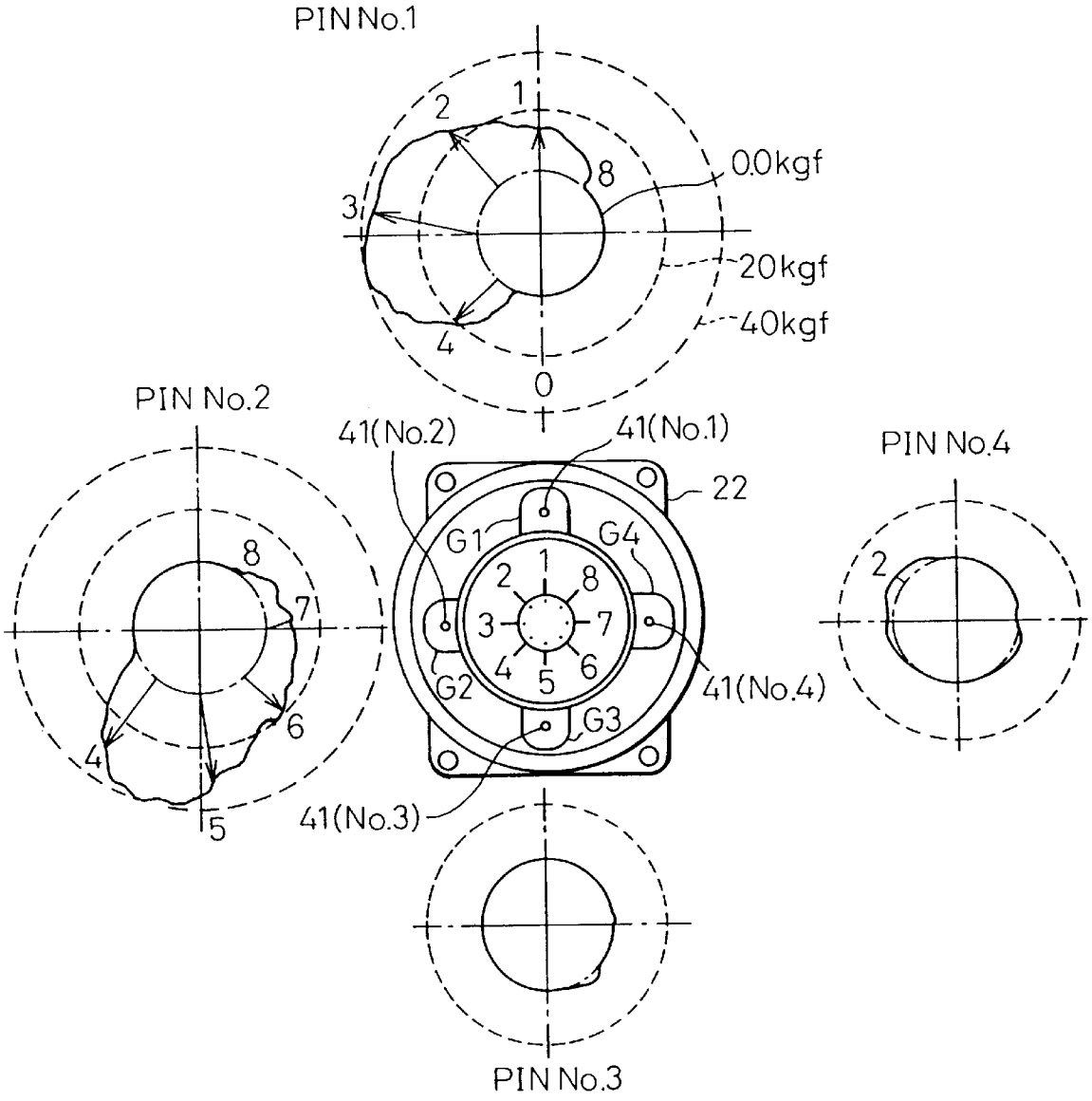
FIG. 5 is a schematic explanatory view illustrating measured data of a load applied to respective pins fixed to the housing of the scroll type compressor.

As shown in FIG. 5, measuring gauges G1 through G4 were attached to four positions adjacent to the four pins 41 press-fitted in the inner face of the front housing 22 so as to measure an extent of a load applied to the respective pins 41 and directions of application of the load during the operation of a scroll type compressor. Further, the experiments were conducted under various different operating or running conditions (R.C.) for simulating various modes of use of the scroll type compressor.

FIG. 5 indicates the measuring result of a load applied to the pins 41 of the four rotation preventing mechanisms 37, identified by No. 1 through No. 4 when the scroll type compressor is operated under one of the running conditions Cl through C6. The four pins 41 identified by No. 1 through No. 4 are equiangularly spaced apart from one another. From the graph of FIG. 5, it will be understood that when the pins 41 identified by No. 1 and No. 2 are subjected to a large load of which the direction is indicated by arrows, the pins 41 identified by No. 3 and No. 4 are subjected to a relatively small load.

Figure 6:
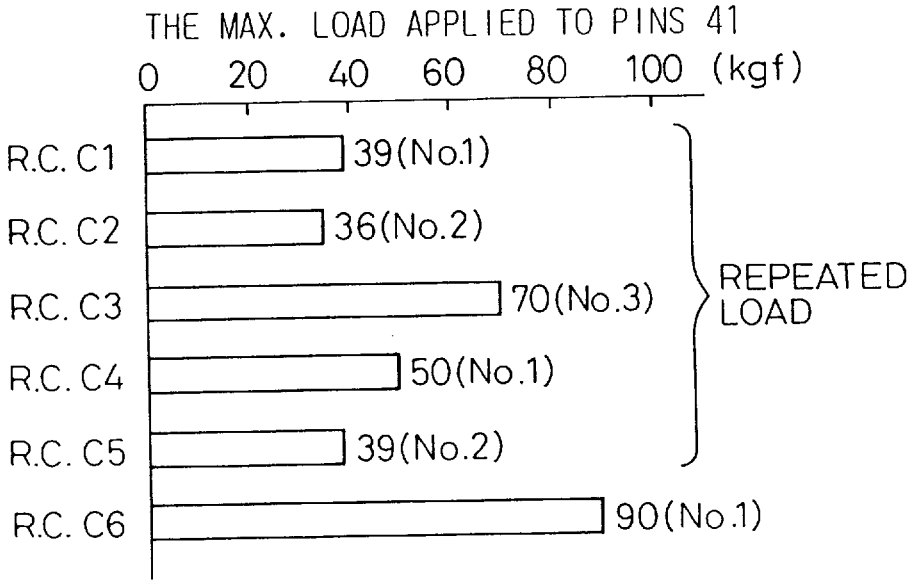
FIG. 6 is a graph illustrating the maximum load applied to the respective pins fixed to the housing of the scroll type compressor at various running condition thereof.

FIG. 6 indicates the peak or maximum load applied to the pins 41 under the running conditions C1 through C6 of the same scroll type compressor as FIG. 5.

From the graphical illustration of FIG. 6, it is understood that when the compressor is operated under the running condition C3, the peak or maximum load applied to the respective pins 41 reaches 70 Kgf, and each of the four pins 41 is subjected to the peak load once per one complete rotation of the compressor.

Under the running condition C6 of the compressor, the respective pins 41 are subjected to a larger peak load, i.e., the load of 90 kgf which corresponds to a load that the compressor is subjected to at the moment of start of the compressor to compress a liquid-state refrigerant. Thus, the load of 90 kgf is not repeatedly applied to the rotation preventing mechanisms 37 of the rotation preventing means during the continuous operating condition of the compressor.

After the experiment to measure the load applied to the pins 40 and 41 of the rotation preventing mechanisms 37, further experiments were conducted to obtain data of a relationship between the dimensions of the afore-mentioned wall thickness T1, T2, and T3 and the mechanical strength of the front housing 22 and the movable base plate 28*a* of the movable scroll element 28.

Figure 7:
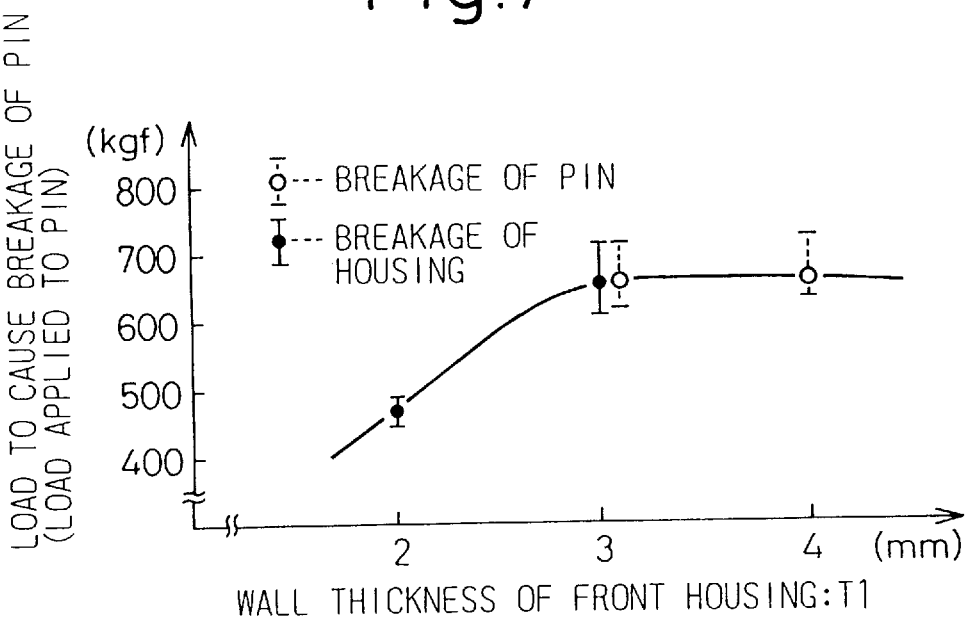
FIG. 7 is a graph illustrating a relationship between the radial thickness of the inner edge portion of the housing and a static load by which the front housing and/or pins fixed to the front housing are broken.

Initially, an experiment to measure a static load causing breaking of the pins 40 and 41, the rings 42, the wall of the front housing 22, and the movable base plate 28*a* of the movable scroll element 28 was conducted in order to estimate the mechanical strength of the rotation preventing mechanisms 37 against a load applied at the start of the operation of the compressor. FIG. 7 indicates a curve showing the measuring result of a load which causes a breakage of either the pins 40 and 41 or the front housing 22. The abscissa and the ordinate of the graph of FIG. 7 represent a change in the wall thickness T1 of the front housing 22 and a load at the start of the compressor. It should be understood that in the compressor used for the experiment, pins similar to the practical pins 41 were press-fitted in the bores 39 of the front housing 22, and a load applied to the pins was gradually increased to measure the load at which the front housing 22 is broken. Further, the wall thickness T1 of the front housing 22 was changed with respect to a given standard wall thickness.

From the experiment of FIG. 7, it was understood that even when the wall thickness T1 of the front housing 22 is set at 2.0 mm, the pins and the front housing 22 can exhibit a large mechanical strength under the application of a large static load to the pins compared with the application of the maximum load of 90 kgf at the start of the operation of the compressor. Further, when the wall thickness T1 of the front housing 22 is set at 3.0 mm, the same number of breakage of the front housing 22 and the pins simultaneously occurs. Thus, it was understood that when T1 is set at 3.0 mm under the application of a static load to the pins, the mechanical strength of the pins and that of the front housing 22 are harmonious.

When the wall thickness T1 of the front housing 22 is set at 4.0 mm, breakage of the pins occurred but breakage of the front housing does not occur at a given static load between 600 and 700 kgf.

Figure 8:
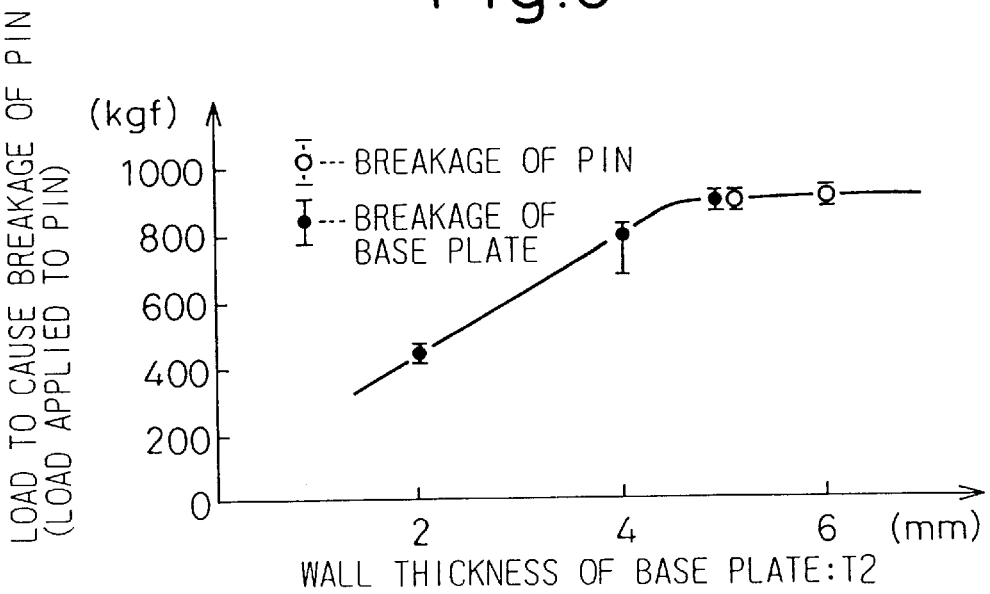
FIG. 8 is a graph illustrating a relationship between the radial thickness of an outer portion of the movable base plate of the movable scroll element and the pins fixed to the movable base plate of the movable scroll.
Figure 9:
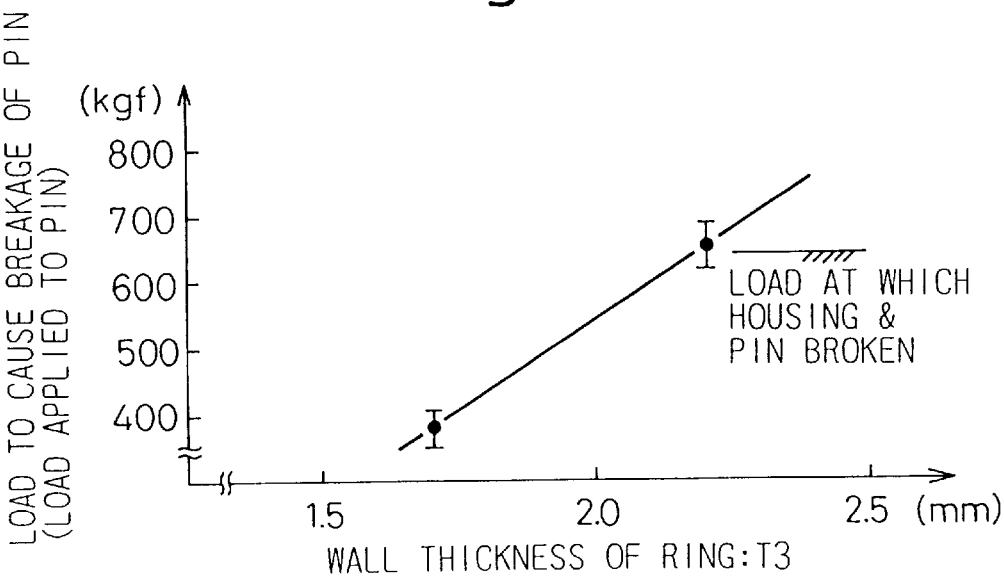
FIG. 9 is a graph illustrating a relationship between the radial wall thickness of the respective rings of the rotation preventing means and a static load applied to the pins of the rotation preventing means and causing breakage of the pins.

The graph of FIG. 8 indicates the measuring result of a load at which the movable base plate 28*a* of the movable scroll element 28 was broken. In the measurement of the breaking load of the base plate 28*a* , pins corresponding to the practical pins 40 are press-fitted in the bores 38 of the base plate 28*a* of the movable scroll element 28, and a load is applied to the pins so as to gradually increase the load level to thereby measure a load at which the base plate 28*a* is broken.

From the result of the experiment of FIG. 8, it was understood that even when the wall thickness T2 of the base plate 28*a* is set at 2.0 mm, the movable base plate 28*a* of the movable scroll element 2 can exhibit a large mechanical strength under the application of a large static load to the pins compared with the application of the maximum load of 90 kgf at the start of the operation of the compressor. Further, when T2 is set at 4.5 mm, the same number of breakages of the pins and the base plate 28*a* occur at a given static load between 800 and 1000 kgf. Thus, it was understood that when the wall thickness of the base plate 28*a* of the movable scroll element 28 is set at 4.5 mm, the mechanical strength of the base plate 28*a* and that of the pins 40 can be harmonious. When T2 is set at 6 mm, only breakage of the pins 40 occurred at a given static load between 800 and 1000 kgf, and no breakage of the base plate 28*a* occurred. The graph of FIG. 9 indicates the measuring result of a load at which the rings 42 of the rotation preventing mechanisms 37 were broken. The experiment was conducted in the similar manner to the experiments of measuring the breaking loads of the front housing 22 and the movable base plate 28*a* of the movable scroll element 28. From the measuring result of FIG. 9, it is understood that when the radial wall thickness T3 of the respective rings 42 is set at 1.7 mm, the mechanical strength of each ring 42 under the application of a static load is far larger than that under the application of the peak load of 90 kgf at the start of the operation of the compressor. When the radial wall thickness T3 of the ring 42 is set at 2.2 mm, breakage of the rings 42 occurred at the same load as the load at which the front housing was broken. Thus, it was confirmed that when T3 is set at 2.2 mm, the mechanical strength of the rings 42 and that of the pins 41 can be harmonious.

From the foregoing description, it will be understood that even when T1 of the front housing 22 is set at 2 mm, when T2 of the movable base plate 28*a* of the movable scroll element 28 is set at 2 mm, and when T3 of the rings 42 is set at 1.7 mm, the mechanical strength of the front housing 22, the movable base plate 28*a* , and the rings 42 can be enough to resist the peak load of 90 kgf applied to the rotation preventing mechanisms 37 at the start of the compressor under the running condition C6.

Nevertheless, it should be appreciated that the respective rotation preventing mechanisms 37 should have a sufficient strength to withstand fatigue due to application of a repeated load rather than the peak load applied thereto at the start of the operation of the compressor. Therefore, further experiments were conducted for measuring and detecting a relationship between the dimensions of the various components of the rotation preventing mechanisms 37 and the fatigue strength of the same mechanisms 37.

Figure 10:
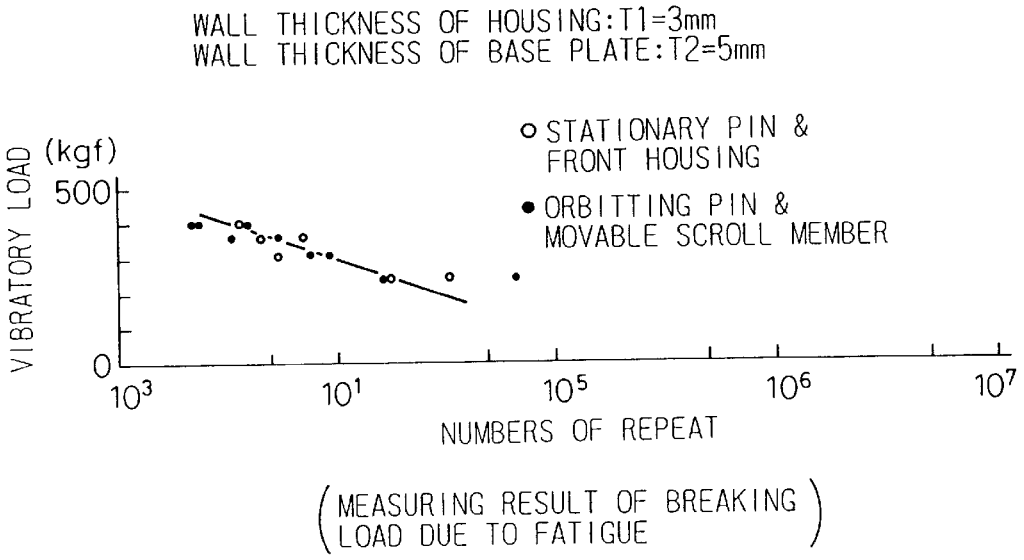
FIG. 10 is a graph illustrating a relationship between a vibratory load and the number of repetitions at which the vibratory load is applied to the pins of the rotation preventing means, and explaining when breakage of the pins due to fatigue thereof is caused, under such a condition that both the housing of the compressor and the movable base plate of the movable scroll element are formed to have predetermined radial thicknesses T1 and T2, respectively.

FIG. 10 shows the measuring result of a vibratory load at which the front housing 22 and the movable scroll element 28 are subjected to fatigue breakage. In the graph of FIG. 10, white dots indicate the fatigue breakage of the front housing 22, and black dots indicate the fatigue breakage of the movable scroll element 28. It should be noted that the experiments were conducted by using the compressor for the experiment purpose wherein the wall thickness T1 of the front housing 22 is set at 3 mm, and the wall thickness T2 of the movable base plate 28*a* of the movable scroll element 28 is set at 5 mm. Further, the pins 40 and 41 were press-fitted in the bores 38 and 39 of the front housing 22 and the base plate 28*a* of the movable scroll element 28, and various vibratory loads having different widths of vibration were applied to the pins 40 and 41 to detect a given number of repetitions at which the front housing 22 and the movable scroll element 28 are subject to fatigue breakage. Further, in the conducted experiments, the wall thickness T1 of the front housing 22 and the wall thickness T2 of the base plate of the movable scroll element 28 are set at 3 mm and 5 mm, respectively.

Figure 11:
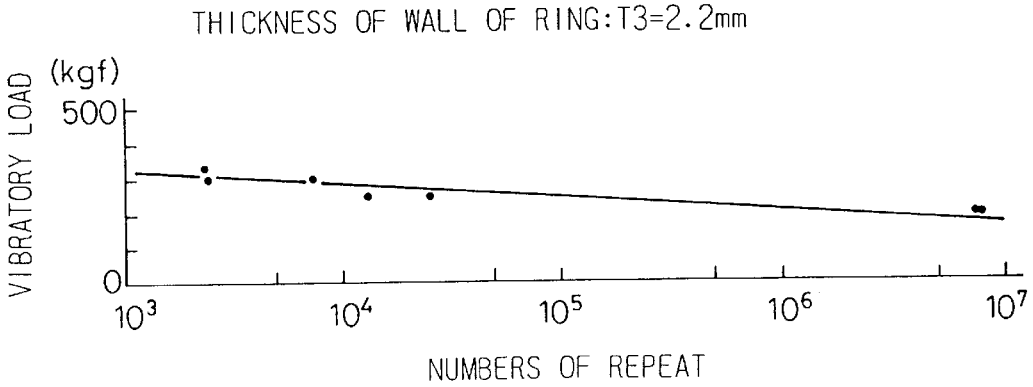
FIG. 11 is a graph illustrating a relationship between the number of repetitions at which a vibratory load is applied to the pins of the rotation preventing means and a change in the vibratory load, and explaining when breakage of the pins is caused by fatigue thereof, under such an experimental condition that the ring is formed to have a predetermined radial thickness T3.

FIG. 11 shows the measuring result of a vibratory load at which the ring 42 is subject to fatigue breakage. In the experiment, the radial wall thickness T3 of the ring 42 is set at 2.2 mm. The measuring method of this experiment was similar to those of the above-mentioned experiment of the fatigue breakage of the front housing 22 and the base plate 28*a* of the movable scroll element 28, as shown in FIG. 10.

Figure 12:
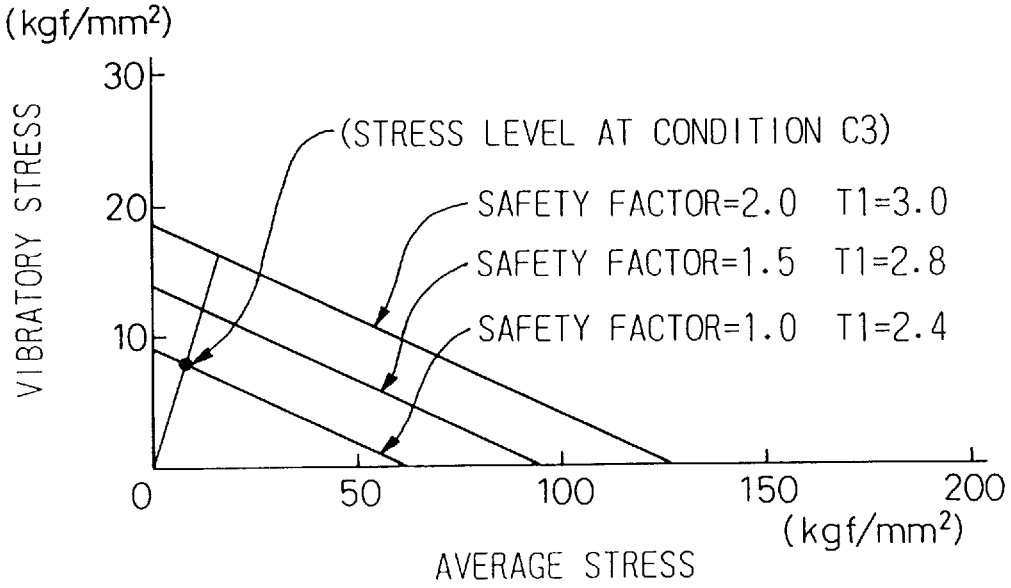
FIG. 12 is a graph illustrating a relationship between an average stress of the pins of the rotation preventing means and a vibratory load applied to the pins, and explaining the safety factors of the pins under a condition such that the housing is formed to have various predetermined radial thicknesses T1.
Figure 13:
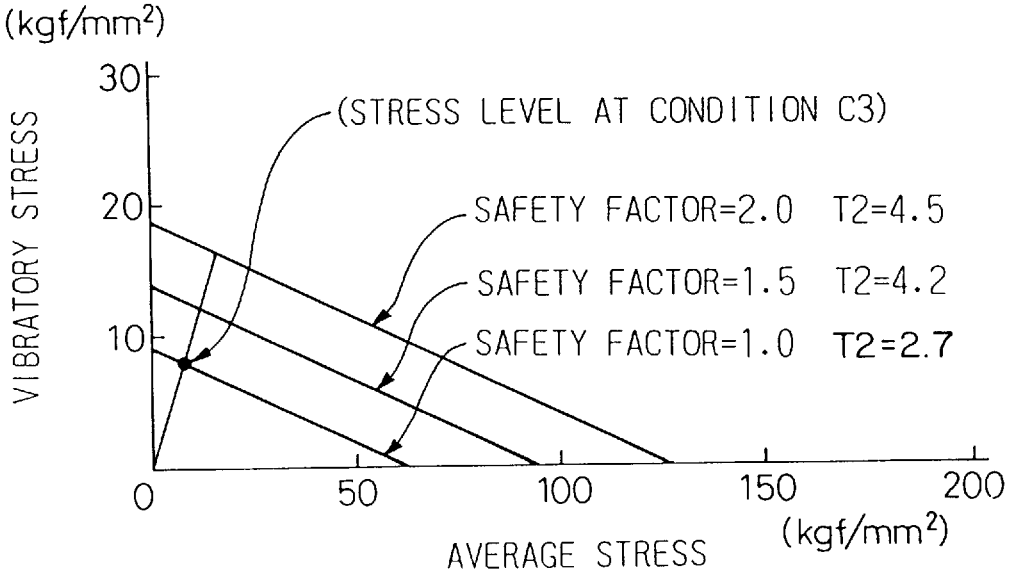
FIG. 13 is a graph illustrating a relationship between an average stress of the pins of the rotation preventing means and a vibratory load applied to the pins, and explaining the safety factors of the pins under a condition such that the movable base plate is formed to have a predetermined radial thickness T2.
Figure 14:
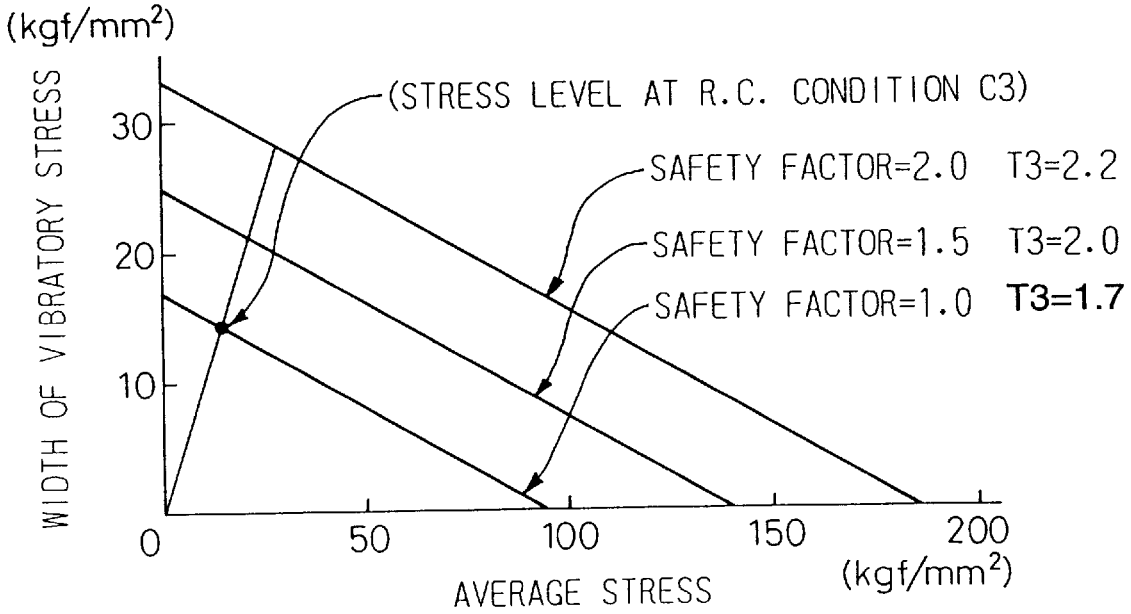
FIG. 14 is a graph illustrating a relationship between an average stress of the rings of the rotation preventing means and a vibratory stress applied to the pins, and explaining the safety factors of the rings under a condition such that the respective rings of the rotation preventing means is formed to have predetermined radial thicknesses T3.

Further, from the result of the above-mentioned experiments of the fatigue breakage of the front housing 22, the base plate 28*a* of the movable scroll element 28, and the ring 42, graphs were made as shown in FIGS. 12 through 14, which indicate a relationship between an average stress and a vibratory stress of the rotation preventing mechanisms 37. Then, safety factors for the respective rotation preventing mechanisms 37 were measured during the operation of the compressor under the running condition (R.C.) C3 and under application of stress due to the repeating load of 70 kgf.

The graph of FIG. 12 indicates the limit of fatigue of the front housing 22 under repeated application of a load to the front housing 22. From the graph of FIG. 12, it was understood that when the wall thickness T1 of the front housing 22 is set at 2.4 mm, the safety factor of the mechanisms 37 is 1.0 against repeated application of the peak load of 70 kgf. When T1 is increased from 2.4, the safety factor is in turn increased.

The graph of FIG. 13 indicates the limit of fatigue of the base plate 28*a* of the movable scroll element 28 under repeated application of a load thereto. From the graph of FIG. 13, it is understood that when the wall thickness T2 of the base plate 28*a* of the movable scroll element 28 is set at 2.7 mm, the safety factor of the mechanisms 37 is 1.0 against repeated application of the peak load of 70 kgf. When T2 is increased from 2.7, the safety factor is in turn increased.

The graph of FIG. 14 indicates the limit of fatigue of the rings 42 under repeated application of a load thereto. From the graph of FIG. 14, it is understood that when the radial wall thickness T3 of the rings 42 is set at 1.7 mm, the safety factor of the mechanisms 37 is 1.0 against repeated application of the peak load of 70 kgf. When T3 is increased from 1.7, the safety factor is in turn increased.

Figure 15:
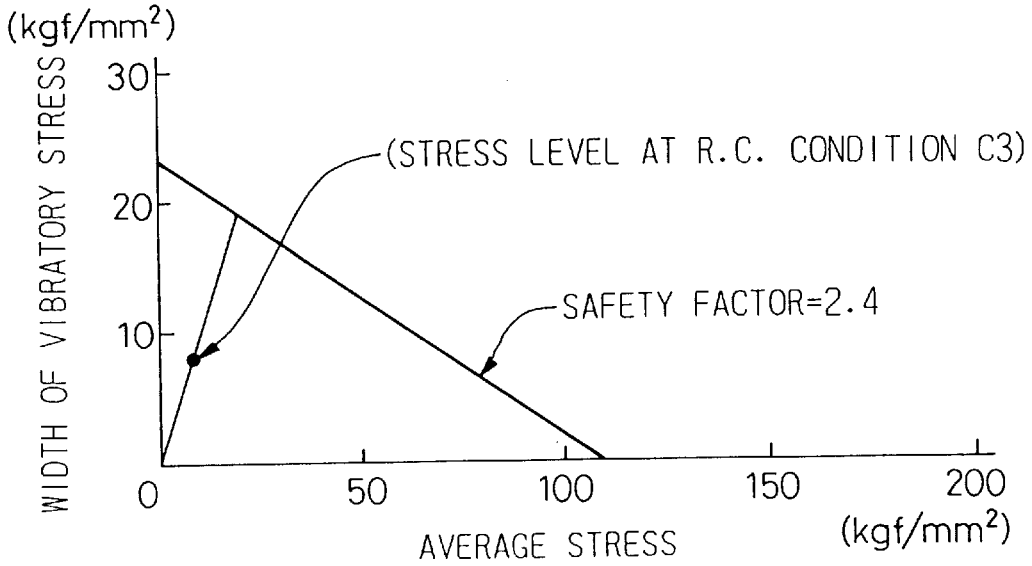
FIG. 15 is graph illustrating a relationship between an average stress of the pins of the rotation preventing means and a vibratory stress applied to the pins, and explaining the safety factors of the pins under a condition such that the respective pins of the rotation preventing means are formed to have a predetermined diameter.

FIG. 15 indicates the limit of fatigue of the pins 40 and 41 which have respective outer diameters D3 and D4 determined by the formula (3), under repeated application of a load to the respective pins 40 and 41. From the graph of FIG. 15, it is understood that when the diameters D3 and D4 of the pins 40 and 41 are set at 4.2 mm, the safety factor of the pins 40 and 41 is 2.4 under repeated application of the peak load of 70 kgf.

On the basis of the measuring results of the above-described experiments, the wall thickness T1 of the front housing 22 is determined to be equal to or larger than 2.4 mm, the wall thickness T2 of the base plate 28*a* of the movable scroll element 28 of the rotation preventing means is determined to be equal to or larger than 2.7 mm, and the radial thickness of the rings 42 of the rotation preventing means is determined to be equal to or larger than 1.7 mm. As a result, the scroll type compressor can be provided with the mechanically reinforced rotation preventing means having mechanical strength sufficient for preventing breakage or damage of the pins, the rings incorporated in the rotation preventing means, and the portions of the front housing and the movable base plate of the movable scroll element located around and supporting the pins.

From the foregoing description of the embodiment of the present invention, it will be understood that according to the present invention, the rotation preventing means of a scroll type compressor can have sufficient mechanical or physical strength for preventing the components of the rotation preventing means from being damaged or broken even under a severe operation condition of the compressor such as the operation compressing liquid-state refrigerant. Thus, the long operation life of the scroll type compressor is ensured without unfavorable increases in the size of the overall compressor, the manufacturing cost of the rotation preventing means, and vibration of the compressor during the operation thereof.

Many and various modification will occur to persons skilled in the art without departing the scope and spirit of the invention claimed in the accompanying claims.

What we claim:

1. A scroll type compressor comprising:

a housing means defining therein a chamber which receives a compressing mechanism and has a predetermined inner end face, a stationary scroll element received in the chamber of said housing means and having a stationary base plate positioned to be spaced apart from said predetermined end face of said housing means and a stationary spiral or wrap element attached to said stationary base plate, a movable scroll element received in the chamber of said housing means and having a movable base plate positioned to adjoin said predetermined inner face of said housing means at one of opposite end faces thereof and a movable spiral or wrap element integrally attached to the other of the opposite end faces of said movable base plate, said stationary and movable scroll elements being engaged with one another so as to define a plurality of compression chambers therebetween for compressing a refrigerant, a drive means for driving said movable scroll element so as to orbit about a center of said stationary scroll element to thereby cause a shifting of the plurality of compression chambers from an outer portion to a central portion of said respective spiral elements of said stationary and movable scroll elements, the shifting of said compression chambers gradually compressing the refrigerant, and a rotation preventing means for preventing said movable scroll element from being rotated about is own axis when said movable scroll element orbits about the center of said stationary scroll element, said rotation preventing means including a plurality of angularly spaced pairs of pins, each pair of pins having a first pin fixedly attached to said predetermined inner end face of said housing means and a second pin fixedly attached to said one of the opposite end faces of said movable base plate of said movable scroll element, said first and second pins being arranged to be parallel with one another, and a plurality of rings fitted around said plurality of pairs of first and second pins so as to cooperate with said first and second pins to thereby prevent rotation of said movable scroll element about its own axis, wherein said first pins of said rotation preventing means fixed to said predetermined inner face of said housing means are arranged to be spaced apart radially from a circular inner edge of said predetermined inner face extending around said chamber of said housing means, a thickness of said housing means left between an outer surface of said respective first pins and said circular inner edge of said predetermined inner face of said housing means being predetermined to be equal to or larger than 2.4 mm, said first and second pins of said rotation preventing means being press-fitted in said inner end face of said housing means and said one of the opposite end faces of said movable base plate of said movable scroll element, said first and second pins being formed with rounded corners at ends thereof to be press-fitted in said inner end face of said housing means and said one of the opposite end faces of said movable base plate.

2. A scroll type compressor according to claim 1, wherein said first and second pins are further formed with rounded corners at ends thereof opposite from said ends to be press-fitted and to be smoothly engaged with said rings of said rotation preventing means.

3. A scroll type compressor according to claim 1, wherein said inner circumference of each of said rings and the outer circumference of each of said first and second pins define spaces $S_1$ and $S_2$, respectively, the total of said spaces $S_1$ and $S_2$ being set at a value between 40 through 120 microns.

* * * * *